United States Patent [19]

Ford

[11] Patent Number: 4,784,222

[45] Date of Patent: Nov. 15, 1988

[54] WELLHEAD SEALING ASSEMBLY

[75] Inventor: David L. Ford, Houston, Tex.

[73] Assignee: Cameron Iron Works USA, Inc., Houston, Tex.

[21] Appl. No.: 98,195

[22] Filed: Sep. 17, 1987

[51] Int. Cl.[4] ..... E21B 33/03

[52] U.S. Cl. ..... 166/85; 166/115; 166/125; 166/134; 166/182; 166/208; 166/217; 277/116.6; 277/116.8; 277/118; 285/139

[58] Field of Search ..... 166/85, 86, 115, 125, 166/182, 195, 134, 208, 217, 387; 285/139, 140; 277/236, 116.6, 116.8, 117, 118

[56] References Cited

U.S. PATENT DOCUMENTS

| | | | |
|---|---|---|---|
| 1,905,122 | 4/1933 | Baash et al. | 285/139 |
| 3,797,864 | 3/1974 | Hynes et al. | 285/40 |
| 4,131,287 | 12/1978 | Gunderson et al. | 277/191 |
| 4,178,020 | 12/1979 | Dopyera | 285/18 |
| 4,421,164 | 12/1983 | Galle, Jr. | 285/139 X |
| 4,471,965 | 9/1984 | Jennings et al. | 277/26 |
| 4,588,029 | 5/1986 | Blizzard | 166/120 |
| 4,595,053 | 6/1986 | Watkins et al. | 277/236 X |
| 4,595,063 | 6/1986 | Jennings et al. | 166/382 |
| 4,600,055 | 7/1986 | Durst et al. | 166/115 |
| 4,651,818 | 3/1987 | Johnson et al. | 166/115 |
| 4,665,979 | 5/1987 | Boehm, Jr. | 166/208 |
| 4,691,780 | 9/1987 | Galle, Jr. et al. | 166/208 X |

*Primary Examiner*—Hoang C. Dang
*Attorney, Agent, or Firm*—Vinson & Elkins

[57] ABSTRACT

An improved wellhead sealing assembly having an annular body with an outer diameter sufficient to pass through the interior of the wellhead housing and an inner diameter smaller than the exterior of the wellhead hanger so that it lands on the upper end of the hanger, a metal sealing ring secure to said body and adapted to be positioned between the housing and the hanger, said sealing ring having an inner sealing lip for engaging the exterior of the hanger and an upstanding sealing rim, a plurality of locking segments with arms extending radially through said body and projecting beyond the interior of said body, a plurality of load segment carried by said body and engaging the interior of said sealing rim, load pins extending through said body and engaging the interior of each of said load segments and extending inward through and beyond the interior of said body, and a loading wedge ring supported within said body and movable axially therein to engage said load pins and said locking segment arms to move said locking segments into engagement within the interior of the housing and to move said load pins to move said sealing rim into sealing engagement with the interior annulus surface.

8 Claims, 4 Drawing Sheets

WELLHEAD SEALING ASSEMBLY

BACKGROUND

The present invention relates to an improved wellhead seal for providing a metal-to-metal seal between the interior of a wellhead housing and the exterior of a wellhead hanger.

Wellhead seals have long been used to seal between the hanger and the housing in which it is supported. An example of a prior art wellhead seal is disclosed in U.S. Pat. No. 3,797,864 which provides an elastomeric ring positioned between metal end pieces having arms extending onto the inner and outer end portions of the elastomeric seal ring and means for compressing the seal axially to cause it to expand radially into sealing engagement with the inner and outer sealing surfaces.

Another type of wellhead annular seal is disclosed in U.S. Pat. No. 4,595,063 which seal includes inner and outer seal rings positioned on inner and outer surfaces of a sleeve and a U-shaped actuator which engages the ends of the seal ring to create a compression in them by virtue of relative movement between the actuator and the sleeve.

U.S. Pat. No. 4,471,965 discloses another type of seal in which an H-shaped member having arms with rounded sealing ends thereon is used for sealing across an annulus.

U.S. Pat. No. 4,178,020 discloses an H-shaped seal member with opposed wedge rings for use in a slip joint to lock the components together and provide an irreversible metal-to-metal seal.

A U-shaped seal which is wedged inward and outward into sealing engagement with the inner and outer walls of an annulus is disclosed in U.S. Pat. No. 4,595,053.

A resilient packing ring which has upper and lower legs which are actuated by wedges is disclosed in U.S. Pat. No. 1,905,122.

Another wellhead annulus sealing assembly is disclosed in U.S. Pat. No. 4,131,287. This structure includes a seal ring with two upper and two lower arms which are forced into sealing position by upper and lower wedges. The assembly is connected into an assembly by bolts which extend through the wedges and into the seal ring.

SUMMARY

The improved wellhead sealing assembly of the present invention includes an annular body having an outer diameter sufficient to pass through the interior of the wellhead housing and an inner diameter smaller than the exterior of the wellhead hanger so that it lands on the upper end of the hanger, a metal sealing ring secured to said body and adapted to be positioned between the housing and the hanger, said sealing ring having an inner sealing lip for engaging the exterior of the hanger and an upstanding sealing lip, a plurality of locking segments carried by said body and with each including arms extending radially through said body and projecting beyond the interior of said body, a plurality of load segments carried by said body and engaging the interior of said sealing lip, load pins extending through said body and engaging the interior of each of said load segments and extending inward through and beyond the interior of said body, and a loading wedge supported within said body and axially therein to engage said pusher rod and said locking segment arms to move said locking segments into engagement within the interior of the housing and to move said load pins to move said sealing lip into sealing engagement with the interior surface. The loading wedge includes means which releasably retains i in its position of wedging the load pins and the segment arms into the actuated or loaded positions.

An object of the present invention is to provide an improved sealing assembly for sealing between the interior of a housing and the exterior of a hanger with a metal-to-metal seal.

Another object is to provide an improved sealing assembly for sealing between the interior of a housing and the exterior of a member within the housing which is an improved metal-to-metal seal that can only be positively released.

A further object is to provide an improved sealing assembly for sealing an annulus within a well which is easily and quickly installed and released and retrieved.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
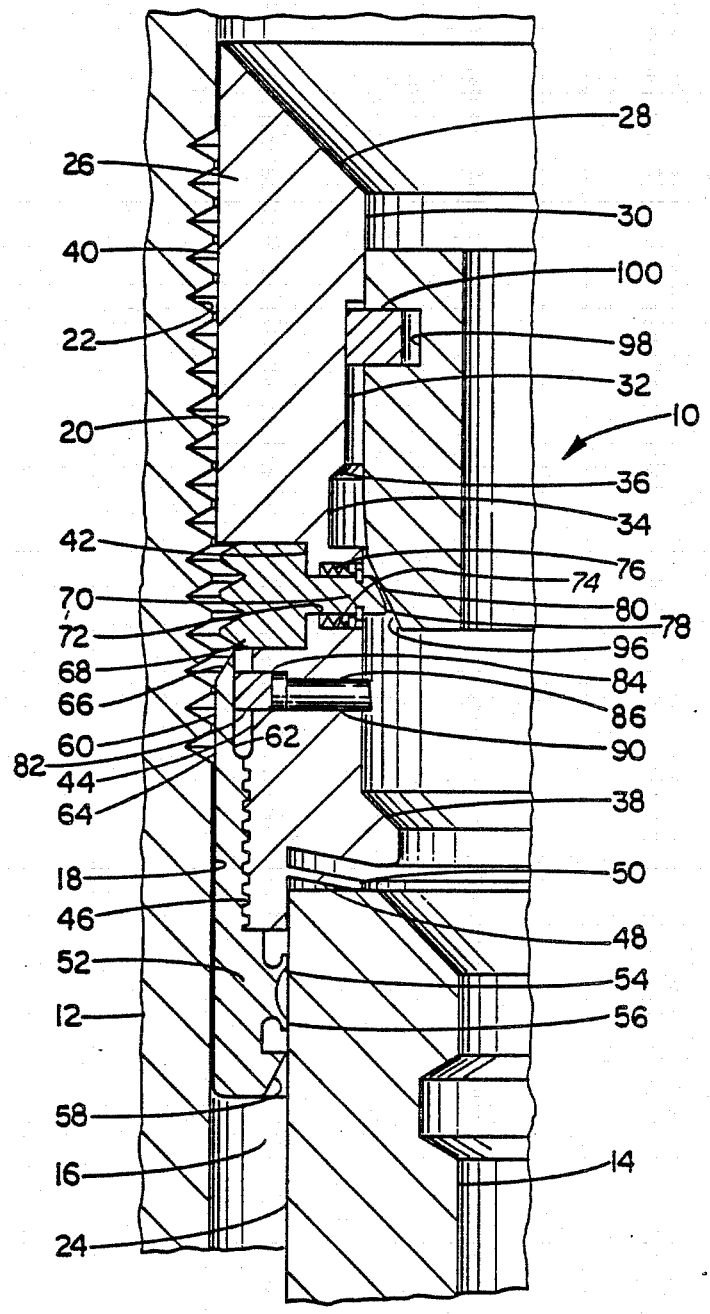
FIG. 1 is a partial sectional view of the improved sealing assembly of the present invention positioned within the annulus between a housing and a well hanger.

Sealing assembly 10 is shown in the drawings for sealing across the annulus between the interior of wellhead housing 12 and the exterior of hanger 14. Sealing assembly 10 is lowered within housing 12 into position within annulus 16 between interior surface 18 of housing 12 which includes a series of teeth 20 and grooves 22 and exterior surface 24 of hanger 14.

Sealing assembly 10 includes annular body 26 having an external diameter which is sufficiently small to be lowered through the interior of housing 12. Body 26 has an upper surface 28 which is tapered downwardly and inwardly to central bore 30. Bore 30 is interrupted by upper recess 32 which extends into lower recess 34. Recess 34 has a greater radial depth than recess 32 and shoulder 36 between recesses 32 and 34 tapers upwardly and inwardly. Bore 30 ends at tapered surface 38 which tapers downwardly and inwardly. Exterior surface 40 of body 26 extends from the upper end of body 26 to annular groove 42. Thread relief 44 in the exterior of body 26 extends below groove 42 to external threads 46. The interior of body 26 below surface 38 includes depending skirt 48 and inwardly and downwardly extending flexible rim 50. Flexible rim 50 is sufficiently stiff to support sealing assembly 10 on landing on the upper surface of hanger 14 and sufficiently flexible to allow axial movement of sealing assembly 10 during its locking operations.

Sealing ring 52 is threaded into threads 46 and includes flexible lips 54 and 56 which extending inwardly and upwardly and inwardly and downwardly, respectively to provide sealing engagement with surface 24 of hanger 14. Lips 54 and 56 are undercut as shown to increase their flexibility and also so that they are responsive to pressure from both above and below whereby the pressure will pressure energize the lips. Tapered surface 58 extends from the lower portion of ring 52 to assist in its entry into annulus 16. The upper end of ring 52 includes rim 60 which has inner thread relief 62 and outer sealing surface 64 with upper tapered surface 66 which tapers upwardly and inwardly.

Arcuate segments 68 are positioned in annular groove 42 and their arms 70 extend radially inward through openings 72 through body 26. Bore 74 extends from openings 72 to the bore 30 and provides room for spring 76 which surrounds arms 70 and is positioned between the outer portion of bore 74 and snap ring 78 which is positioned in the inner portion of arms 70 to urge segments 68 inwardly. The inner ends of arms 70 have tapered surface 80 extending downwardly and inwardly. The outer surface of segments 68 as best seen in FIGS. 1 and 2 includes mating teeth and grooves for engagement within the teeth 20 and grooves 22 on the interior of housing 12.

Figure 3:
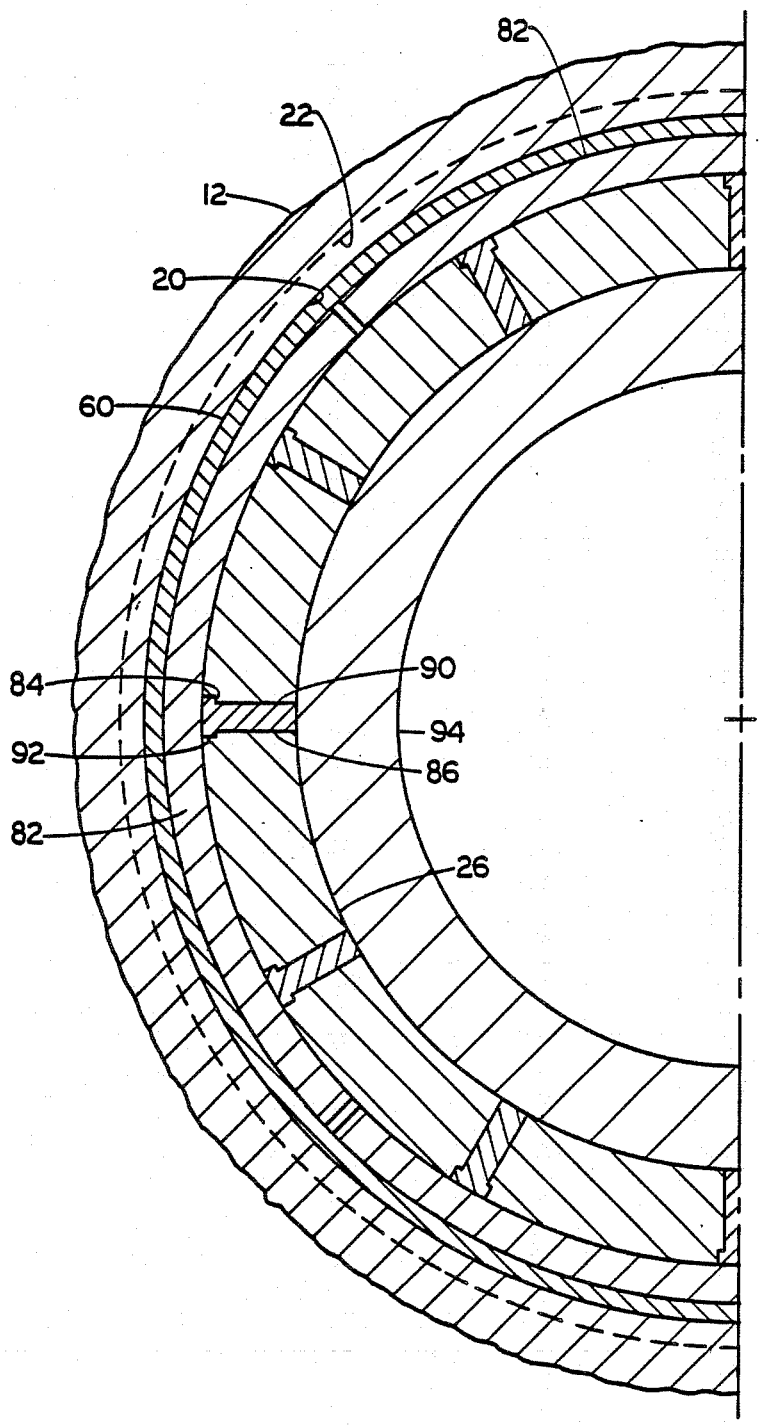
FIG. 3 is a partial transverse sectional view taken along line 3—3 in FIG. 2.
Figure 4:
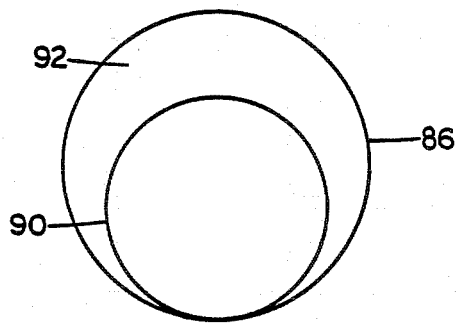
FIG. 4 is an end view of the seal ring load pin.

Seal load segments 82 are arcuate in shape as shown in FIG. 3 and are positioned partially within groove 84 which extends inward of thread relief 44 and partially in the space defined by thread relief 44 and thread relief 62 so that its exterior surface is against the interior surface of rim 60. Load pins 86 extend through body 26 and terminate in inner tapered surfaces 88 which taper downwardly and inwardly. Pins 86 each include shank 90 and outer foot 92. Shank 90 and foot 92 are both circular in section as shown in FIG. 4 with the axis of foot 92 being offset upwardly from the axis of shank 90.

Figure 2:
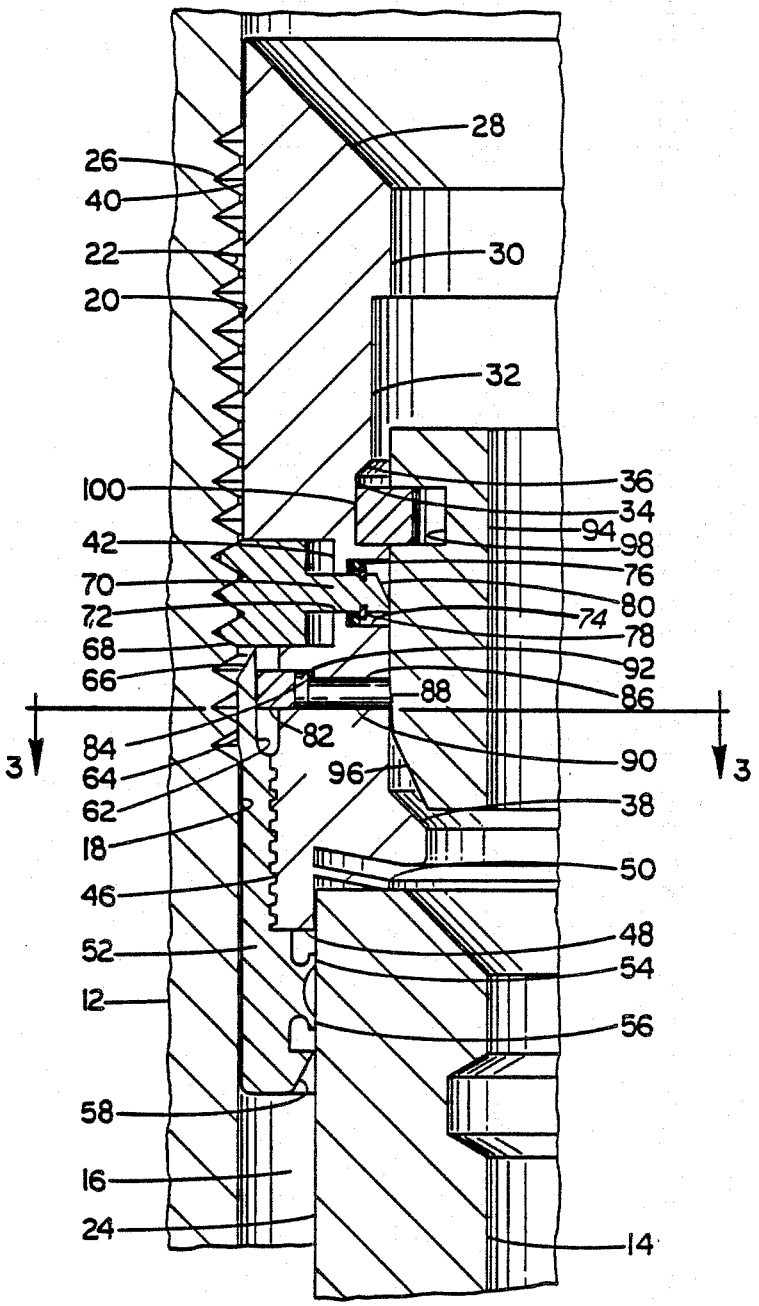
FIG. 2 is another partial sectional view of the sealing assembly shown in sealing position.

Loading wedge ring 94 is positioned within the upper portion of bore 30 as shown in FIG. 1 and includes lower tapered wedging surface 96 and outer groove 98 in which split ring 100 is positioned. Split ring 98 is biased outward and is positioned in engagement with the inner surface of upper recess 32. When sealing assembly 10 is in its desired sealing position as shown in FIG. 1, wedge ring 94 is lowered by use of a suitable tool (not shown) so that both arms 70 of arcuate segments 68 and load pins 86 are engaged and wedged outwardly. This outward movement causes the teeth and grooves on the exterior of segments are in tight gripping engagement with teeth 20 and grooves 22 on the interior of housing 12. The wedging of load pins 86 outward forces rim 60 outward into tight sealing engagement with teeth 20. This brings sealing assembly 10 into the position shown in FIG. 2 in which a metal-to-metal seal is provided by lips 54 and 56 against the exterior surface 24 of hanger 14 and also against the interior surface 18 (the teeth 20) by rim 60.

When seal assembly 10 is initially landed on the upper end of hanger 14 flexible rim 50 which functions as a spring ring. Thus, if some additional axial movement is necessary to achieve mating of the teeth and grooves of arcuate locking segments 68 do not mate with the teeth 20 and grooves 22 on the interior of housing 12, the flexibility of spring rim 50 allows this movement while maintaining contact with hanger 14.

Seal assembly 10 is retrievable since it is only necessary to provide a tool (not shown) which will exert an upward force on wedge ring 94 sufficient to allow tapered surface 36 to cam split locking ring 100 outward into groove 98 and thus allow wedge ring 94 to move upward until split ring 100 engages the upper end of recess 32. This releases the outward force holding locking segments 68 in engagement with teeth 20 and grooves 22 and also releases the outward force on seal load segments 82 which retains rim 60 in sealing engagement with the crest of teeth 20. When wedge ring 94 has disengaged from the inner end of arms 70, spring 76 causes locking segments 68 to retract from engagement with teeth 20. Further upward movement of wedge ring 94 raises body 26 and sealing ring 52 so that they may be retrieved from within housing 12 and sealing ring 52 replaced and sealing assembly 10 reinstalled within annulus 16. The taper on rim surface 66 cams rim 60 inwardly away from teeth 20 and thereby ensures that during retrieval there is no problem of rim 60 being in such engagement with teeth 20 to interfere with such retrieval.

It should be noted that the movement of wedge ring 94 causes locking segments 68 to move and lock seal assembly 10 relative to housing 12 before the loading of seal rim 60 is accomplished. It is preferred that locking segments 68 be a high strength alloy and the material of the sealing ring 52 be stainless steel.

What is claimed is:

1. A sealing assembly for sealing across a wellhead annulus between an outer member forming an outer concave annulus surface and an inner member forming an inner convex annulus surface and having an upwardly facing surface comprising an annular body, a sealing ring secured to said body and having inwardly extending sealing lips for sealing against the inner convex annulus surface and an upstanding rim having an outer diameter to be in close spaced relationship to the outer concave annulus surface, locking segments supported by said body and being movable radially outward into locking engagement with said outer concave annulus surface, loading segments supported by said body and being movable radially outward into loading engagement with the interior of said upstanding rim of said sealing ring, and means positioned within said body for moving said locking segments and said loading segments radially outward to lock said body at its position with said annulus and to force said upstanding rim outward into sealing engagement with said outer concave annulus surface.

2. A sealing assembly according to claim 1 wherein said moving means is a single wedge ring carried by said body and movable therein to wedge said locking segments and said loading segments radially outward.

3. A sealing assembly according to claim 1 including openings through said body at the level of said locking segments, said locking segments including arms extending inwardly through said openings through said body, loading segment openings through said body at the level of said loading segments, and said loading segments having load pins extending through said loading segment openings, said moving means engaging said arms and said load pins for outward movement of said locking segments and said loading segments.

4. A sealing assembly according to claim 3 wherein said moving means includes a loading wedge ring supported within said body and movable axially therein to wedge said arms and said load pins outwardly.

5. A sealing assembly according to claim 4 including means for releasably retaining said loading wedge ring in its axial position in which it has moved said arms and load pins outwardly.

6. A sealing assembly according to claim 1 wherein the outer concave surface of said annulus includes a series of teeth directed inwardly and including outwardly directed teeth on said locking segments having teeth mating with the teeth on said outer annulus concave surface, and said rim, when forced outwardly, is forced into tight gripping and sealing engagement with the teeth of said outer concave annulus surface.

7. A sealing assembly according to claim 6 including means carried by said body for providing initial engagement with the upwardly facing surface against which it is to land and having sufficient flexibility to allow axial movement of said body during the locking movement of said locking segments.

8. A sealing assembly according to claim 7 wherein said flexible initial engagement means includes a lip on the interior of said body at its lower end which extends radially inward and downward and is sufficiently flexible to allow slight axial movement of said body during the locking operation and sufficiently stiff to support the body and sealing ring after landing.

* * * * *